United States Patent [19]

Thornton et al.

[11] Patent Number: 4,542,767

[45] Date of Patent: Sep. 24, 1985

[54] MONITOR FOR DOUBLE SAFETY VALVES

[75] Inventors: Douglas M. Thornton, Rochester; Logan H. Mathis, Southfield, both of Mich.

[73] Assignee: Ross Operating Valve Company, Troy, Mich.

[21] Appl. No.: 482,135

[22] Filed: Apr. 5, 1983

[51] Int. Cl.[4] ..... F15B 13/08

[52] U.S. Cl. ..... 137/596.16; 91/424; 91/448; 137/596.18

[58] Field of Search ..... 137/596.16, 596.18; 91/424, 448

[56] References Cited

U.S. PATENT DOCUMENTS 4,257,455 3/1981 Cameron ..... 137/596.16

4,345,620 8/1982 Ruchser et al. ..... 137/596.16

*Primary Examiner*—Edward G. Favors

*Attorney, Agent, or Firm*—Harness, Dickey & Pierce

[57] ABSTRACT

A safety monitor for a dual valve of the type that provides a malfunction signal when one of the valve members of the dual valve is not in its intended position. The monitor comprises a simple pressure sensing device that senses the pressure downstream of the inlet valve element of each of the valve members for sensing when a pressure exists downstream of the valve element.

3 Claims, 3 Drawing Figures

MONITOR FOR DOUBLE SAFETY VALVES

BACKGROUND OF THE INVENTION

This invention relates to an improved monitor for double safety valves and more particularly to an improved and simplified device for indicating malfunctions.

In order to provide improved safety for pneumatically operated tools such as stamping presses or the like, it has been proposed to provide a double valve assembly between the pressure inlet and the supply port to the pneumatically operated device. With such arrangements, supply pressure is not supplied to the device from the inlet unless both of the valve elements are in an opened position. With such an arrangement, malfunction of one valve element will not permit pressure to be applied to the press nor will it permit actuation of the device. Examples of valves of this type are shown in the following U.S. Pat. Nos. 3,670,767, issued June 20, 1972, reissued on Aug. 19, 1975 under U.S. Pat. No. 28,520 and subsequently reissued on Mar. 1, 1983 under U.S. Pat. Nos. 31,161; 3,757,818, issued Sept. 11, 1973; 3,858,606, issued Jan. 7, 1975; and U.S. Pat. No. 4,257,455, issued Mar. 24, 1981.

In connection with this type of valve, it is also proposed to provide some form of monitoring device that will indicate if one of the valve elements is stuck in a faulted condition. Such a monitoring device will warn the operator if there is a fault condition. In one form of monitor, as shown in aforenoted U.S. Pat. No. 4,257,455, a shuttle valve is provided that is responsive to downstream pressure of the individual valve elements so that if one valve element is pressurized on its downstream side and the other is not, a malfunction signal will be indicated. Such arrangements have particular utility because they permit accurate monitoring of the function of both valve elements. However, such arrangements are complicated and add to the complexity of the valving arrangement.

In another form of monitoring device, a pressure sensing switch is provided in the supply port that provides the output to the device being operated and a restriction is provided in the exhaust port, normally by means of a restricted muffler. Hence, if one of the valve members is stuck in an opened condition, a leakage output pressure will be generated that can provide a malfunction signal. However, such devices require the use of restrictions in the exhaust port and thus can adversely affect the performance of the associated equipment.

It is, therefore, a principal object of this invention to provide an improved and simplified monitor for double valve assemblies.

It is another object of this invention to provide an improved, simplified and low cost device that provides an arrangement for monitoring defects in double valve assemblies to indicate a fault condition under all circumstances.

SUMMARY OF THE INVENTION

This invention is adapted to be embodied in a device for sensing and indicating a malfunction in a pneumatic control system for presses or the like comprising a pressure inlet, a supply outlet and an exhaust. A pair of valve means each having three valving parts operated thereby are provided for controlling the communication between the pressure inlet, the supply outlet and the exhaust. The first of each of the valving parts is effective to control the communication of pressure from the inlet to a respective intermediate pressure area of each of the valve means. The second of each of the valving parts is effective to control the communication of the intermediate pressure area of the other of the valve means with the supply outlet. The third of each of the valving parts is effective to control the communication of the supply outlet with the exhaust. Each valve means is each movable between a first position wherein the first and second valve parts are closed and the third valve part is opened and a second position wherein the first and second valve parts are opened and the third valve part is closed. The assembly is thus capable of communicating the inlet with the supply and for closing communication of the supply with the exhaust when both of the valve members are in their second positions, for closing communication of the inlet with the intermediate pressure areas, closing communication of the intermediate pressure areas with the supply outlet and opening communication of the supply outlet with the exhaust when the valve means are both in their first position; and for precluding communication of the inlet pressure to the supply when both of the valve means are not in their second positions. In accordance with the invention, means are provided for sensing pressure in either of the intermediate pressure areas for providing a malfunction signal when the valve means are intended to both be in their first positions.

DETAILED DESCRIPTION OF THE PREFERRED EMBODIMENT OF THE INVENTION

Figure 1:
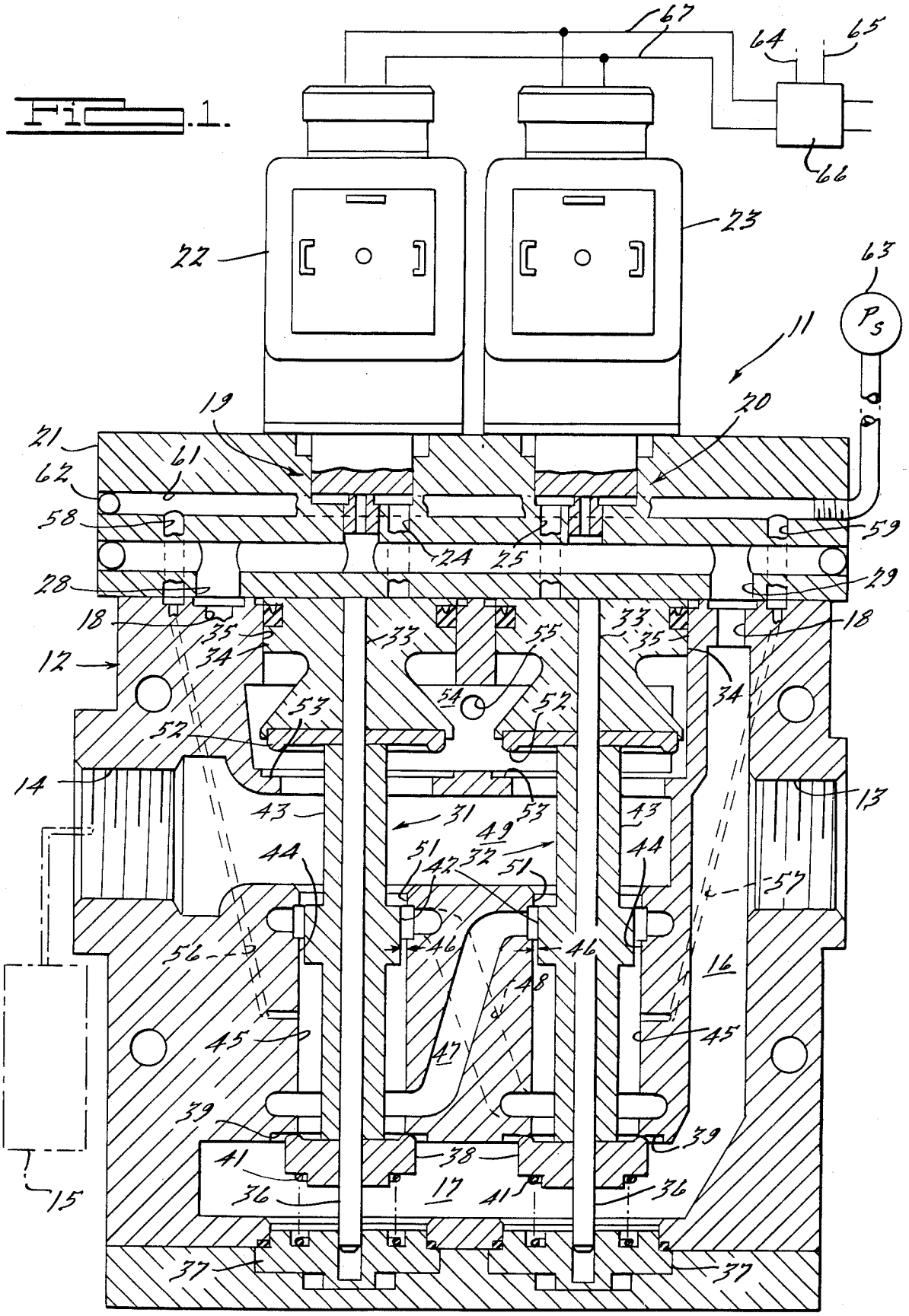
FIG. 1 is a cross-sectional view taken through a double valve arrangement embodying a safety monitor constructed in accordance with the invention and showing certain related components of the system schematically. The valving elements are shown in their closed non-operating condition in this figure.

A double safety valve and monitor of this invention is generally indicated at 11 and comprises a housing generally indicated at 12. The housing has an inlet port 13 at one side thereof and a supply outlet port 14 at the opposite side, the outlet port being connected to an operated chamber 15 which may be the working chamber of a clutch-brake for a press. Conventionally, pressurizing of chamber 15 will cause the clutch to be engaged, operating the press, whereas exhausting of chamber 15 will result in the press brake being applied.

Inlet port 13 leads to a housing passage 16 which conducts pressurized fluid to an inlet chamber 17 adjacent the bottom portion of the housing. Passage 16 also leads to a port 18 which can supply two pilot valves 19 and 20. The pilot valves 19 and 20 are carried within a valve block 21 supported in a known manner on the top side of the housing 12. As illustrated, these could be normally closed three-way pilot valves operated by solenoids 22 and 23, respectively. When the solenoids are de-energized, passages 24 and 25 leading from the pilot valve outlet ports to the housing 12 will be connected to suitable pilot valve exhaust ports (not shown). When the solenoids 22 and 23 are energized, passages 24 and 25 will be supplied with pressurized fluid from ports 18 which lead to supply ports 28 and 29 formed in the block 21.

A pair of valve members including valve stems generally indicated at 31 and 32 are provided in housing 12. The valve stems are of identical construction, each valve stem having a rod 33 extending therethrough with a piston 34 fixed to the upper end thereof, Each piston is slidably mounted in a respective cylinder 35 supplied by passage 24 or 25.

Extensions 36 are formed at the lower ends of rods 33 and are supported by bearings 37 in the lower end of housing 12. The entire valve stem will thus be radially supported during its sliding movement at its opposite ends rather than in an intermediate portion thereof.

Each valve member includes an inlet poppet valve 38 secured to rod 33 above extension 36 and within chamber 17. This poppet valve is engageable with a seat 39 against which it is urged by a helical coil compression spring 41 disposed between the poppet valve 38 and the bearing 37. Since poppet valves 38 are subject to inlet chamber pressure upon closing, they will be held in a sealed condition.

A pair of spool valves 42 are formed on intermediate portions of valve stems 31 and 32. These spool valves are formed as enlargements on sleeves 43 carried by rod 33, which coact with lands 44 in bores 45 within the housing. As shown, spool valves 42 may be provided with a predetermined slight amount of clearance indicated at 46 so that any leakage of pressurized fluid will be predetermined and controlled. It should also be observed that the spool valves will not be subject to wear by rubbing or sliding against lands 44 because any side pressures on the valve stems will be resisted by pistons 34 and extensions 36 rather than by the spool valves themselves. Thus, after continued usage, the slight leakage past the spool valves is predictable and will not exhibit any noticeable change.

A pair of crossover passages 47 and 48 are provided which lead from intermediate pressure chambers formed by the bores 45 downstream of the inlet poppet valve 38 of each valve stem to the spool valve of the other valve stem. This is, crossover passage 47 connects the intermediate pressure chamber downstream of the poppet valve 38 of valve stem 31 with spool valve 42 of valve stem 32, whereas passage 48 leads from the intermediate pressure chamber downstream of the poppet valve 38 of valve stem 32 to spool valve 42 of valve stem 31. Thus, the spool valves will act as inlet valves or second valves which are downstream from and in series with the poppet valves. A supply outlet chamber 49 is formed in housing 12 above spool valves 42, with passages 51 leading from the spool valves to this outlet chamber. The supply chamber 49 is connected with supply outlet port 14.

A pair of exhaust poppet valves 52 are formed at the ends of the valve stems 31 and 32 adjacent pistons 34. When the valve stems are in their deactivated position, these exhaust valves are moved away from seats 53, permitting outlet chamber 49 to be connected to an exhaust chamber 54 having an exhaust port 55. Outlet port 14 is thus connected in parallel with exhaust port 55 whereas it is connected by each of two parallel paths from inlet port 13, each path having two valves in series.

The valve block 21 includes a monitoring device for indicating malfunction of the valve arrangement. This monitoring device is provided with signals of the pressures in the intermediate pressure portions downstream of the poppet valves 38 provided by the bores 45. For this purpose, a pair of sensing ports 56 and 57, are formed in the housing 12 and extend from the bores 45 downstream of the poppet valves 38 and upstream of the spool valves 42 to the upper face of the housing 12. The sensing ports 56 and 57 may be generally restricted in size and communicate with sensing ports 58 and 59, respectively, formed in the valve block 21. The ports 58 and 59 are intersected by a cross drilled passage 61 that is closed at one end by means of a plug 62. The cross drilled passage 61 communicates with a pressure responsive device, indicated generally by the reference numeral 63. Device 63 may be a pressure responsive switch or any other type of known arrangement for sensing pressure and providing a signal with a pressure of predetermined magnitude is existent in the passage 61.

In operation, assuming an initial condition in which the solenoids 22 and 23 are de-energized, the double valve will be in the position shown in FIG. 1. That is, both poppet valves 38 and both spool valves 42 will be closed, and outlet chamber 49 will be connected to exhaust port 55 through parallel exhaust valves 52. It should be observed that when in the position of FIG. 1, there will be no pressure in intermediate pressure chambers formed by the bores 45. Both pressure sensing passages 56 and 57 will therefore be depressurized and the pressure responsive device 63 will sense no pressure. The fact that poppet valves 38 are aided in their closed position by the pressure behind them will insure that there will be no pressure in intermediate chambers defined by the bores 45.

Figure 2:
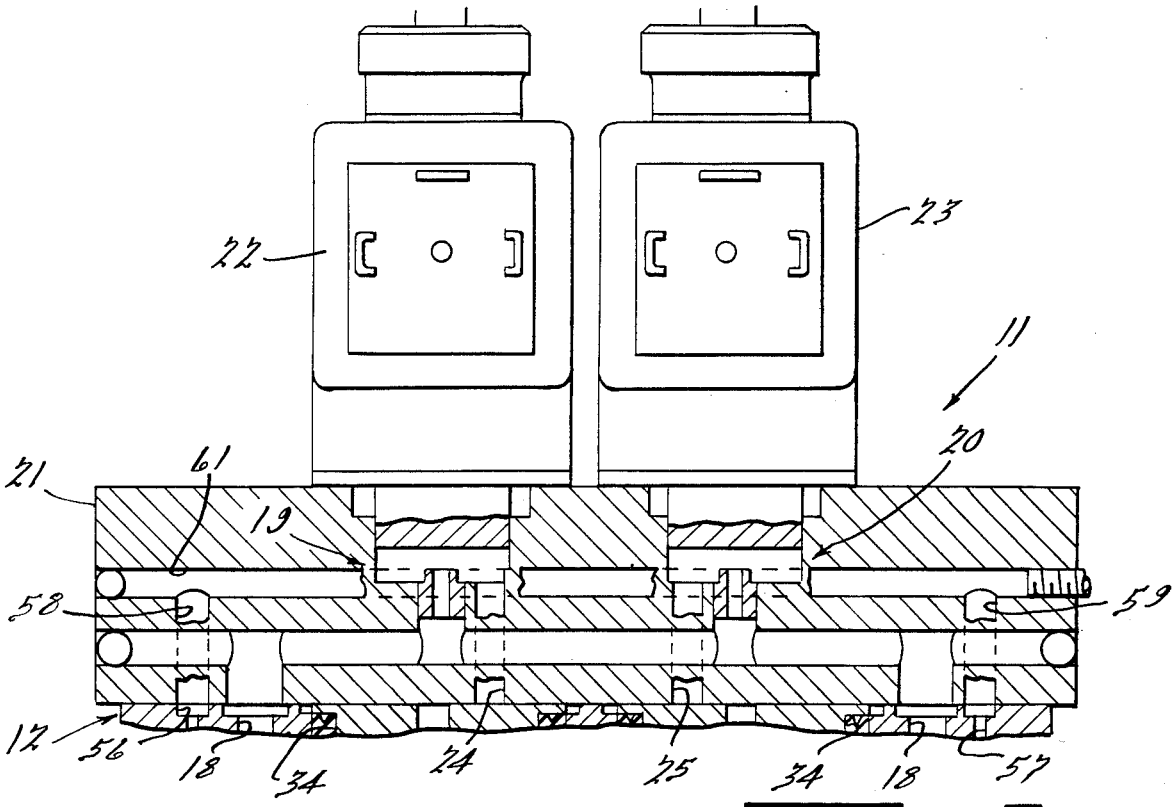
FIG. 2 is a partial cross-sectional view showing the portion of the safety monitor when the valving assembly is in its opened operative position.

Upon energization of pilot valve solenoids 22 and 23, such as by depression of a pair of palm buttons 64 and 65 to close a control switch shown schematically at 66 and energize lines 67 leading to the solenoids 22 and 23, cylinders 35 will be pressurized and valve stems 31 and 32 shifted downwardly (FIG. 2). This will open the inlet poppet valve 38 and the inlet spool valve 42 of each valve stem. Pressurized fluid will flow through the inlet poppet of valve stem 31 through the open spool valve 42 of valve stem 32 to the outlet chamber 49. Simultaneously, pressurized fluid will flow through the open poppet valve 38 of valve stem 32 and through the spool valve 42 of valve stem 31 to the outlet chamber. Exhaust valves 52 will be closed and volume 15 will be pressurized.

When the solenoids 22 and 23 are energized and the valve spools 31 and 32 are moved to their opened position so that pressure will be supplied from the inlet 13 to the chamber 49 and outlet 14 to the device 15, there will be a pressure signal sensed at the sensing ports 56 and 57. However, an electrical circuit (not shown) is incorporated into the wiring for the pressure responsive device 63 so that the device 63 will not give a malfunction signal under the condition when the solenoids 22 and 23 have been energized. Any suitable circuit of a known type may be provided for insuring against the provision of a malfunction signal when both solenoids 22 and 23 have been energized.

De-energization of pilot valve solenoids 22 and 23 will exhaust piston chambers 35, and springs 41 aided by the inlet pressure in chamber 17 will shift the two valve stems upwardly, opening exhaust ports 52 and closing poppet valves 38 and spool valves 42. Volume 15 will thus be exhausted and pressures in sensing passages 56 and 57 will also drop to zero. It should be observed that during the downward and upward movement of both valve stems, spool valves 42 will not rub against their lands 44 and there will thus be little or no wear or erosion which could increase leakage of the spool valves.

Figure 3:
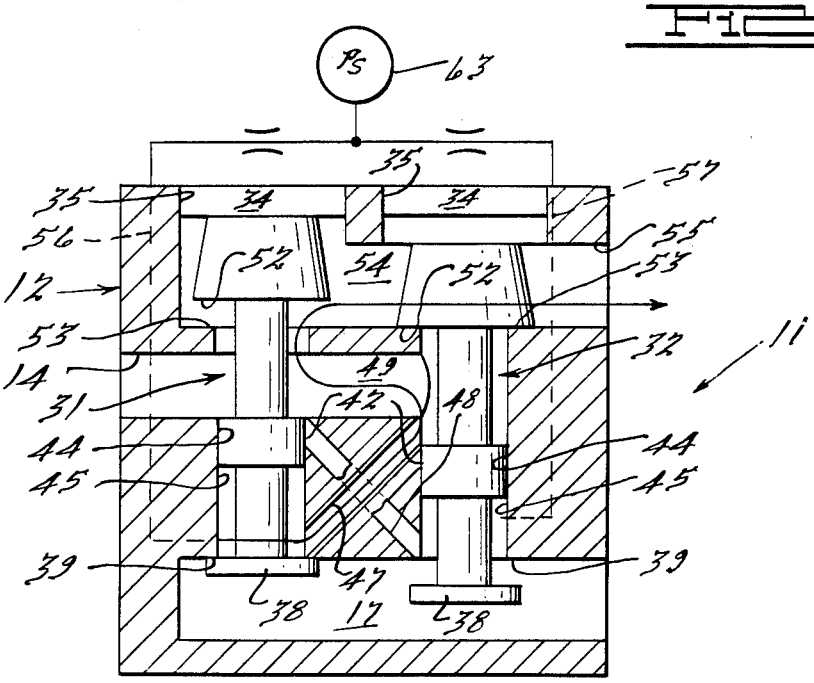
FIG. 3 is a schematic view showing the system in a faulted condition.

In the event one of the valve stems 31 or 32 becomes stuck in its opened position at the completion of a cycle, the pressure switch 63 will provide a fault signal. This condition is shown in FIG. 3 wherein it is assumed that the right hand valve stem 32 is stuck in its opened position. When this occurs, inlet pressure from the inlet 13 will flow past the opened poppet valve 38 associated with the valve stem 32. However, this pressure cannot be transmitted to the device 15 since the spool valve 42 associated with the valve stem 31 will be closed. Therefore, there will only be sight leakage which is immediately discharged to the exhaust through the open exhaust poppet valve 52 associated with the valve stem 31. However, the inlet pressure or a pressure that is slightly less than the inlet pressure, will be experienced in the intermediate chamber provided by the bore 45 above the poppet valve 38 of the valve stem 32. This pressure will be transmitted through the sensing port 57 to the pressure responsive device 63 so as to provide a failure signal.

It should be noted that the electrical cutout will not be controlling the pressure responsive device 63 at this time since the palm buttons 64 and 65 are no longer energized. Hence, a fault signal will be generated.

It should be readily apparent that the same condition will prevail in the event the valve stem 31 becomes stuck in its opened condition and the valve stem 32 closes. In this case, the pressure signal will be transmitted from the sensing port 56 to operate the pressure switch 63.

If desired, an appropriate electrical control may be incorporated so as to prevent actuation of the solenoids 22 and 23 upon subsequent re-energization of the palm switches 54, 65 once the pressure responsive device 63 has given a fault signal. An appropriate circuit for achieving this result is believed to be well within the scope of those skilled in this art, and, for that reason, has not been illustrated in detail.

While it will be apparent that the preferred embodiment of the invention disclosed is well calculated to fulfill the objects above stated, it will be appreciated that the invention is susceptible to modification, variation and change without departing from the proper scope or fair meaning of the appended claims.

We claim:

1. An arrangement for sensing a malfunction in a pneumatic control system for presses or the like comprising a pressure inlet, a supply outlet, and an exhaust, a pair of valve means each having three valving parts operated thereby, the first of each valving part being effective to control the communication of pressure from said inlet to a respective intermediate pressure area of each of said valve means, the second of each of said valving parts being effective to control the communication of the intermediate pressure area of the other of said valve means with said supply outlet, and the third of each of said valving parts being effective to control the communication of said supply outlet with said exhaust, said valve means each being movable between a first position wherein said first and second valve parts are closed and said third valve parts are opened and a second position wherein said first and second valve parts are opened and said third valve parts are closed for communicating said inlet with said supply outlet and for closing communication of said supply outlet with said exhaust when both of said valve members are in their second positions, for closing communication of said inlet with said intermediate pressure areas, closing communication of said intermediate pressure areas with said supply outlet and opening communication of said supply with said exhaust when said valve means are both in their first position, and for precluding communication of inlet pressure to said supply outlet when both of said valve means are not in their second position, the improvement comprising means responsive to actual pressure for sensing pressure in either of said intermediate pressure areas for providing a malfunction signal when said valve means are intended to be in their first position.

2. An arrangement as set forth in claim 1 wherein the means for sensing pressure comprises a pair of pressure sensing ports each extending from the intermediate pressure area of the respective valve means to a single pressure responsive device.

3. An arrangement as set forth in claim 2 wherein the pressure responsive device comprises a switch.

* * * * *